US005501186A

United States Patent [19]

Hara et al.

[11] Patent Number: 5,501,186

[45] Date of Patent: Mar. 26, 1996

[54] ENGINE VALVE CONTROL MECHANISM

[75] Inventors: Seinosuke Hara; Akira Hidaka; Yoshihiko Yamada, all of Atsugi, Japan

[73] Assignee: Unisia Jecs Corporation, Atsugi, Japan

[21] Appl. No.: 280,874

[22] Filed: Jul. 27, 1994

[30] Foreign Application Priority Data

Jul. 27, 1993 [JP] Japan ..... 5-185018

[51] Int. Cl.[6] ..... F01L 13/00

[52] U.S. Cl. ..... 123/90.16; 123/90.17; 123/90.31

[58] Field of Search ..... 123/90.15, 90.16, 123/90.17, 90.22, 90.27, 90.31, 90.39, 90.41, 90.44, 90.45

[56] References Cited

U.S. PATENT DOCUMENTS

| | | | |
|---|---|---|---|
| 3,633,555 | 1/1972 | Raggi | 123/90.17 |
| 5,003,939 | 4/1991 | King | 123/90.17 |
| 5,074,260 | 12/1991 | Yagi et al. | 123/90.17 |
| 5,080,053 | 1/1992 | Parsons | 123/90.17 |
| 5,161,493 | 11/1992 | Ma | 123/90.17 |
| 5,199,393 | 4/1993 | Baldassini | 123/90.17 |
| 5,333,579 | 8/1994 | Hara et al. | 123/90.17 |
| 5,365,896 | 11/1994 | Hara et al. | 123/90.17 |

FOREIGN PATENT DOCUMENTS 2263529 7/1993 United Kingdom .

*Primary Examiner*—Weilun Lo
*Attorney, Agent, or Firm*—Foley & Lardner

[57] ABSTRACT

An engine valve control mechanism is disclosed in which the eccentricity of an intermediate member can be varied by a pivotable support and a valve lift of a cylinder valve is varied in response to the varying eccentricity such that a reduced valve lift is produced during operation with the intermediate member held eccentric with a driving shaft which drives, via the intermediate member, a cam which actuates the valve.

7 Claims, 9 Drawing Sheets

FIG. 9A
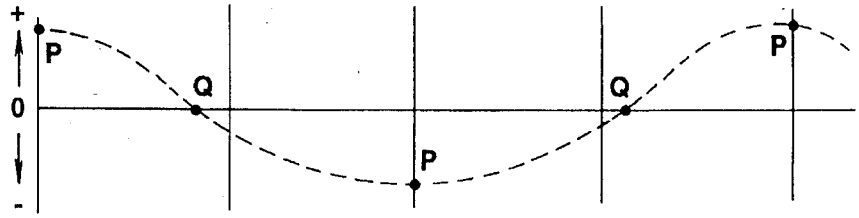
FIG. 9B
FIG. 9C
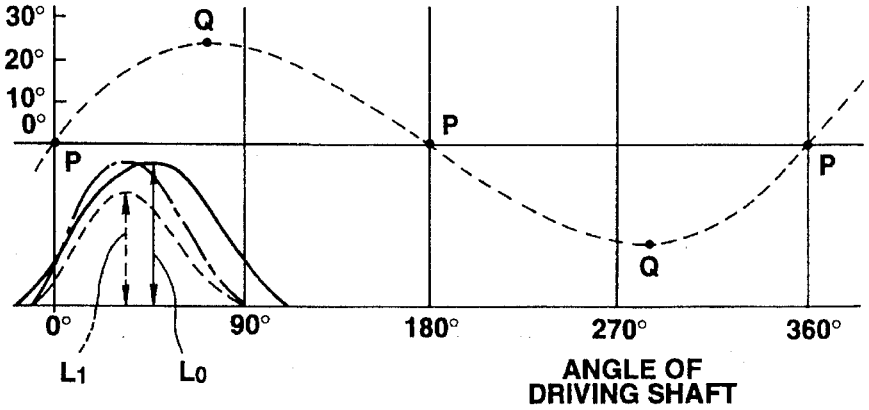

ENGINE VALVE CONTROL MECHANISM

BACKGROUND OF THE INVENTION

The present invention relates to an internal combustion engine cylinder head structure of the overhead camshaft type and more particularly to an engine valve control mechanism.

U.S. Pat. No. 3,633,555 discloses a device for moving a cam relative to its driving shaft. This device is applicable to an internal combustion engine to vary the movement of the cams which control the intake and/or exhaust valves of the engine. This known device comprises a drive member rotatable with a driving shaft, and an intermediate member mounted in an external bearing which is eccentric with respect to the shaft. The shaft extends through an opening in the intermediate member dimensioned to allow limited movement of the bearing to vary the eccentricity. A cam is coaxial with the shaft and rotatable relative thereto. The device includes a first coupling between the drive member and the intermediate member at a first position spaced from the shaft axis, and a second coupling between the intermediate member and the cam at a second position angularly spaced from the first position with respect to the shaft axis. The two couplings are so spaced from the shaft axis that they are at varying distances from the axis of the intermediate member during operation. Each of these couplings has a movable connection with the intermediate member permit the variation in its distance from the axis the intermediate member.

GB-A 2 263 529 discloses an engine valve control mechanism incorporating a device similar to that shown in U.S. Pat. No. 3,633,555.

An object of the present invention is to improve an engine valve control mechanism employing the same control concept such that stress which the cylinder valve is subjected to is reduced sufficiently over the whole range of engine operation from low to high engine speeds.

SUMMARY OF THE INVENTION

According to the present invention, there is provided an engine valve control mechanism, comprising:

a cylinder valve;

a driving shaft rotatable about a shaft axis;

a cam rotatable relative to said driving shaft to actuate said cylinder valve;

a support;

an intermediate member supported in said support for rotation about an axis;

a first coupling between said driving shaft and said intermediate member at a first position spaced from said shaft axis;

a second coupling between said intermediate member and said cam at a second position angularly spaced from said first position with respect to said shaft axis, said first and second couplings being so spaced from said shaft axis that they are at varying distances from said axis of said intermediate member during operation, each of said first and second couplings having a movable connection to permit the variation in its distance from said axis of said intermediate member;

means for varying the eccentricity of said intermediate member;

means responsive to the varying eccentricity of said intermediate member for varying a valve lift of said cylinder valve.

BRIEF DESCRIPTION OF THE DRAWINGS

FIG. 9A shows, in a dotted curve, the variation of deviation in angular speed of the cam versus an angle: of driving shaft based on the assumption that the driving shaft turns at an angular speed;

FIG. 9B shows, in a dotted curve, the variation of deviation in phase of the cam versus the angle of driving shaft based on the assumption that the driving shaft turned at the angular speed;

FIG. 9C shows, in fully drawn line, a valve lift when the intermediate member is held in the concentric relation with the driving shaft and in a dotted curve a valve lift with the intermediate member in eccentric relation with the driving shaft.

DETAILED DESCRIPTION OF TEE INVENTION

Figure 1:
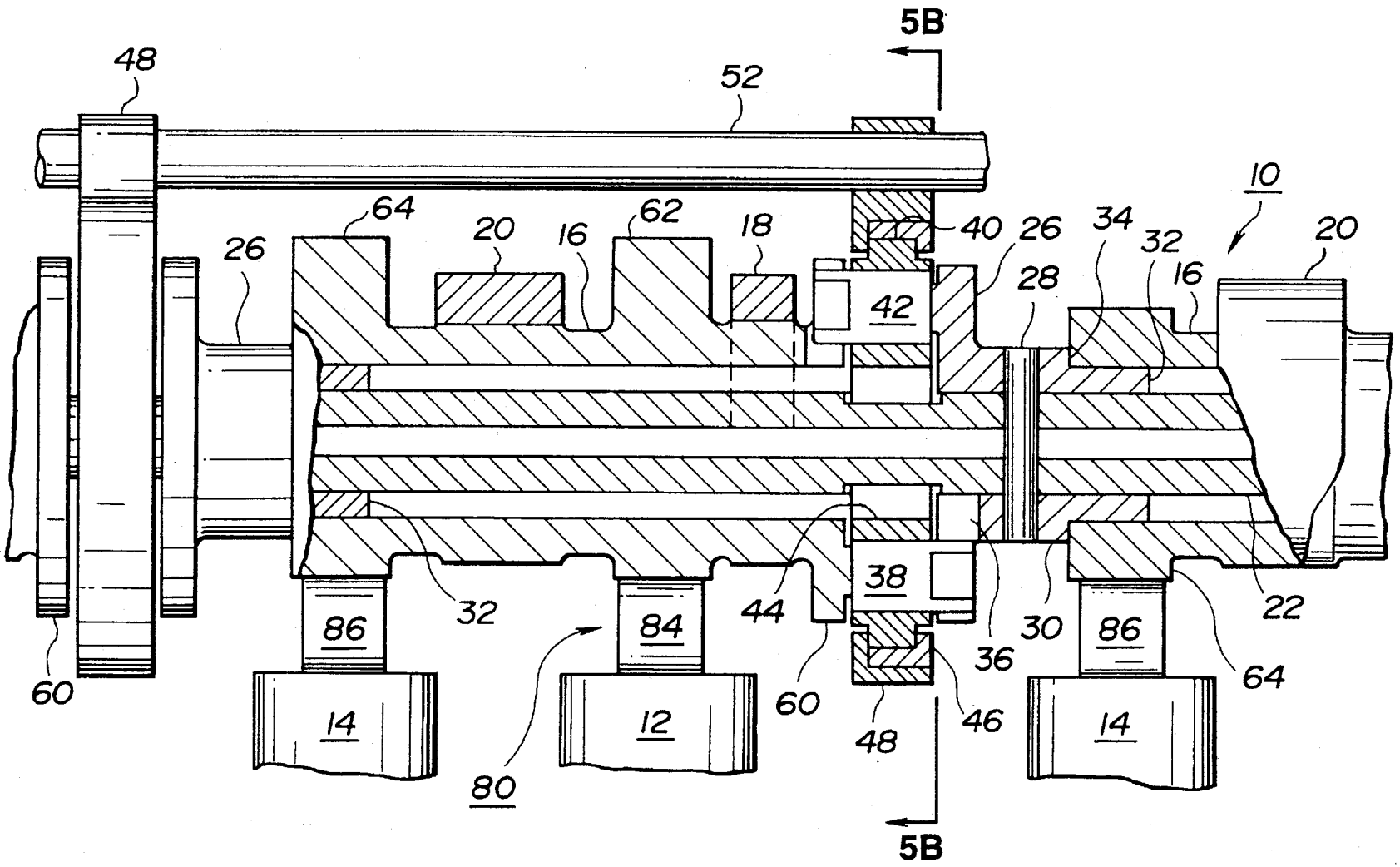
FIG. 1 is a fragmentary side elevation, partly sectioned, of a first embodiment of an engine valve control mechanism for a four cylinder internal combustion engine.
Figure 2:
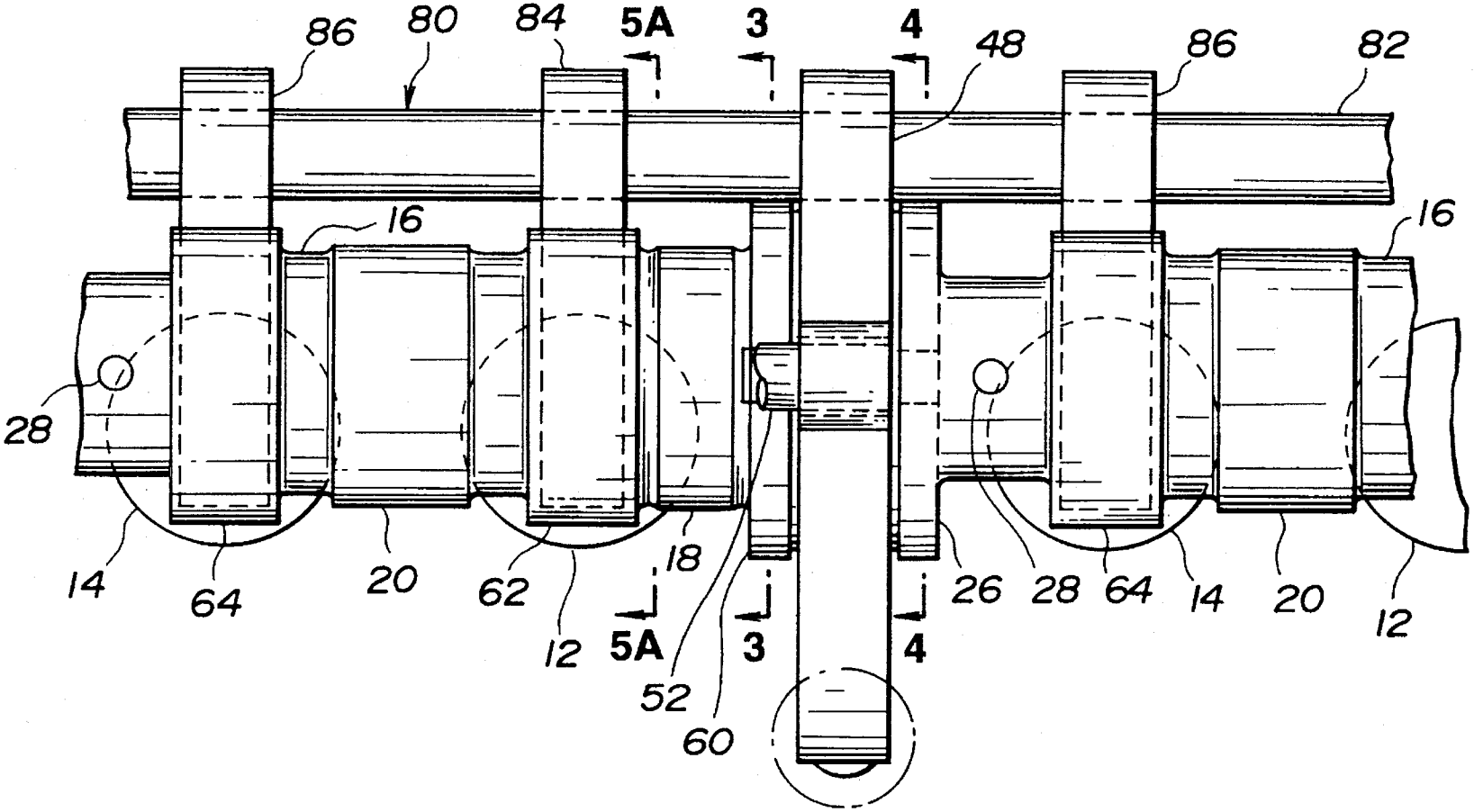
FIG. 2 is a fragmentary top plan view of the control mechanism.
Figure 3:
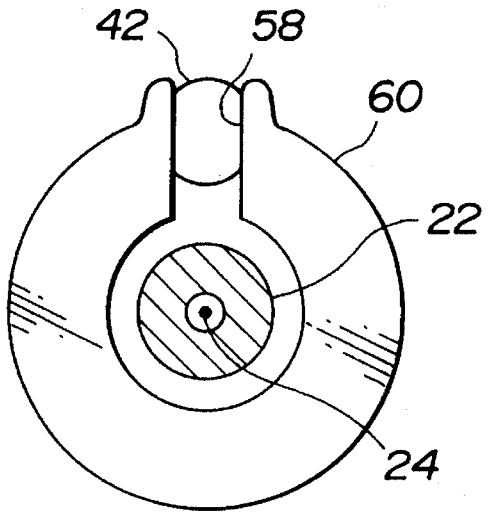
FIG. 3 is a section taken through the line 3—3 in FIG. 2.
Figure 4:
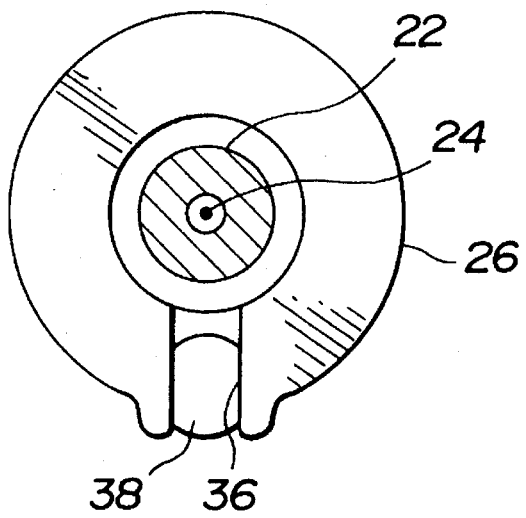
FIG. 4 is a section taken through the line 4—4 in FIG. 2.
Figure 5:
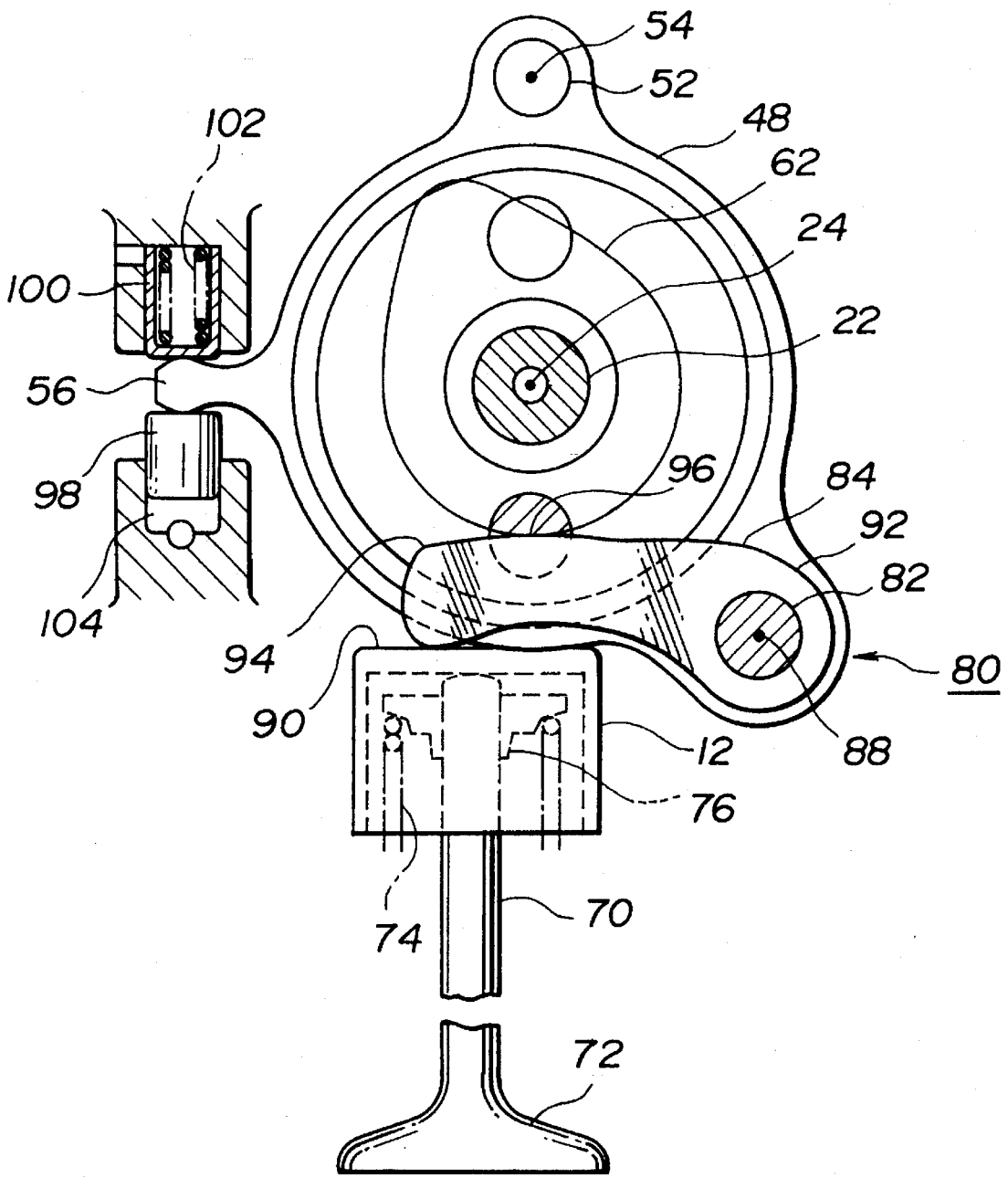
FIG. 5 is a combined view resulting from superimposing a section taken through the line 5A—5A in FIG. 2 on a section taken through the line 5B—5B in FIG. 1.

Referring to FIGS. 1, 2 and 5, there is shown diagrammatically a portion of an engine valve control mechanism 10 fit into an internal combustion engine cylinder head of the overhead camshaft type for actuating two engine cylinders having tappets 12 and 14. The engine has four cylinders in this embodiment and two intake cylinder valves per each cylinder which are to be actuated by the valve control mechanism 10.

Instead of a single conventional camshaft, the mechanism 10 uses four hollow double cams 16 arranged in line and rotatably supported by the engine cylinder head via cam brackets 18 and 20. Extending through all of the cams 16 is a driving shaft 22. The driving shaft 22 is supported within the cams 16 and is rotatable about a shaft axis 24 (see FIG. 5) by conventional means such as a toothed wheel and a chain. The driving shaft 22 has fixed thereto four drive members or collars 26 which drives the cams 16, respectively. As best seen in FIG. 1, the drive collar 26 is fixedly coupled with the driving shaft 22 by means of a cotter 28 and has a sleeve 30. The sleeve 30 has a reduced diameter end portion 32 fit into the adjacent cam 16 and an annular shoulder 34 abutting the adjacent end of the cam 16. With the reduced diameter end portions 32 of the drive collars 26, the cams 16 are held in concentric relation with the driving shaft 22 for relative rotation thereto about the shaft axis 24. Mainly due to the annular shoulders 34, relative motion of the cams 16 in the direction of the shaft axis 24 is restricted.

As shown in FIGS. 1, 2, 3 and 4, the drive collar 26 is formed with a radial slot 36 slidably engaged by a first pin 38 of an intermediate member in the form of an annular disc 40. The pin 38 is rotatably supported by the annular disc 40 and projects from one face of the disc into the radial slot 36. Projecting from the opposite face of the annular disc 40 is a second pin 42 which is angularly spaced from the first pin 38 with respect to the shaft axis 24. In this embodiment, the second pin 42 is symmetrical to and angularly spaced through an angle of 180 degrees to the first pin 38.

The annular disc 40 has a central hole 44 and is fitted around the driving shaft 22 with ample radial clearance. The central hole 44 is wide so that the disc 40 does not touch the surface of the driving shaft 22 and is free to move into positions eccentric with respect to the driving shaft 22. The disc 40 is supported by a bearing 46 in a support or disc housing 48 for rotation about an axis 50 (see FIG. 8). The disc housing 48 is supported by a shaft 52 and pivotable about an axis 54 parallel to the shaft axis 24. The disc housing 48 is annular and has an handle 56 angularly spaced from the shaft 52. Moving the handle 56 from the position shown in FIG. 7 to the position shown in FIG. 8 or vice versa causes the disc housing 48 and disc 40 to move in a plane perpendicular to the shaft axis 24.

The second pin 42 is rotatably supported by the disc 40 and slidably engages a radial slot 58 in a driven collar 60, forming an integral part and thus rotatable with the adjacent cam 16. The cam 16 has two cam lobes 62 and 64 for the tappets 12 and 14 of the cylinder valves.

As best seen in FIG. 5, the cylinder valve is of the poppet type having the tappet 12, a stem portion 70 and a head portion 72. The cylinder valve is biased to a valve closed position (see FIG. 5) by a spring 74 which reacts between the cylinder head structure (not shown) and a spring retainer 76.

A rocker arm mechanism 80 includes a fulcrum in the form of a rocker shaft 82 pivotally supporting rigid rocker arms 84 and 86. The rocker shaft 82 is supported by the disc housing 48 and angularly spaced from the pivotal axis 54 such that, when the disc housing 48 is in the position shown in FIG. 5 (or FIG. 7), the fulcrum, i.e., an axis 88 of the rocker shaft 82, is slightly higher than or as high as a level plane including a flat top face 90 of the tappet 12, while when the disc housing 48 has been pivoted counterclockwise viewing in FIG. 5 to the position shown in FIG. 8, the rocker shaft 82 is lifted and the axis 88 of the rocker shaft 82 is held distant further, from the level plane, than it was when the disc housing 48 was in the position shown in FIG. 5.

In FIG. 5, the rocker arm 84 has one end portion 92 rotatably supported by the rocker shaft 82 and has opposite end portion 94 in direct contact with the flat top face 90 of the tappet 12. The rocker arm 84 has a cam follower portion 96 in association with the cam lobe 62. In this embodiment, the cam follower portion 96 is in direct contact with the cam lode 62.

Figure 6:
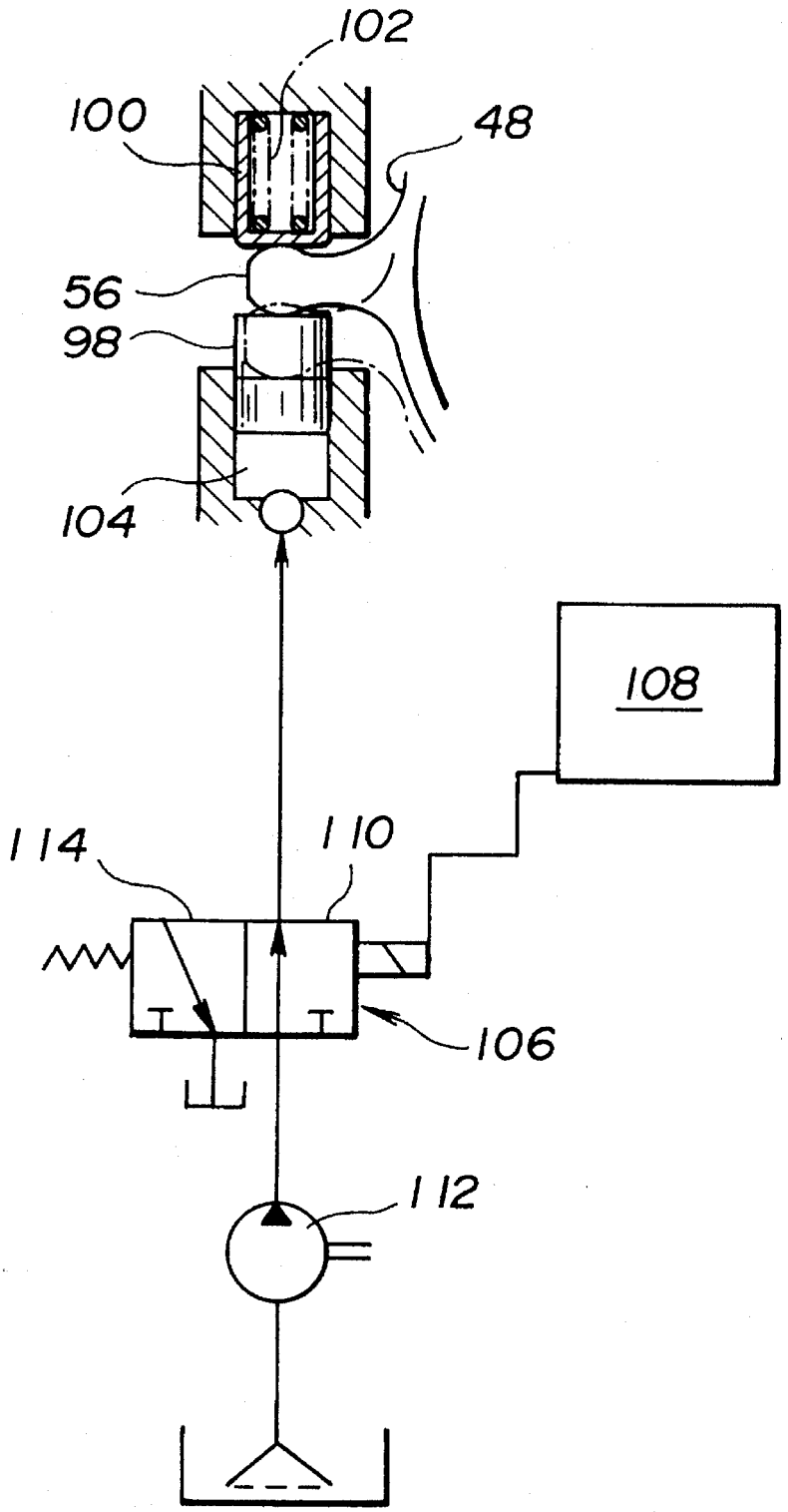
FIG. 6 is a hydraulic diagram.

The disc housing 48 can be moved by hydraulic means shown in FIG. 6. The hydraulic means include a hydraulic piston 98 opposed to a spring biased piston 100 which is biased by a spring 102 to hold the handle 56 of the disc housing 48 in contact with the hydraulic piston 98. The hydraulic piston 98 assumes a projected position shown by the fully drawn line in response to supply of hydraulic fluid to a piston chamber 104 against the bias of the spring 102 to hold the disc housing 48 in the position shown in FIG. 7. In response to discharge of hydraulic fluid from the piston chamber 104, the hydraulic piston 98 is retracted by the spring 102 to assume a retracted position shown by one-dot chain line to hold the disc housing 48 in the position shown in FIG. 8. The supply of hydraulic fluid to and discharge thereof from the piston chamber 104 is conducted by a two position solenoid valve 106. Energization or deenergization of the solenoid valve 106 is responsive to an output signal from a control unit 108. The solenoid valve 106 has a first position as illustrated at 110 in which hydraulic fluid from a pump 112 is supplied to the piston chamber 104 and a second position as illustrated at 114 in which hydraulic fluid is discharged from the piston chamber 104. The control unit 108 receives as input information engine speed and throttle position of the engine. The control logic carried out by the control unit 108 is such that during operation at high engine speeds, the solenoid valve 106 takes the first position 110, while during operation at low engine speeds, the solenoid valve 106 assumes the second position 114.

Figure 7:
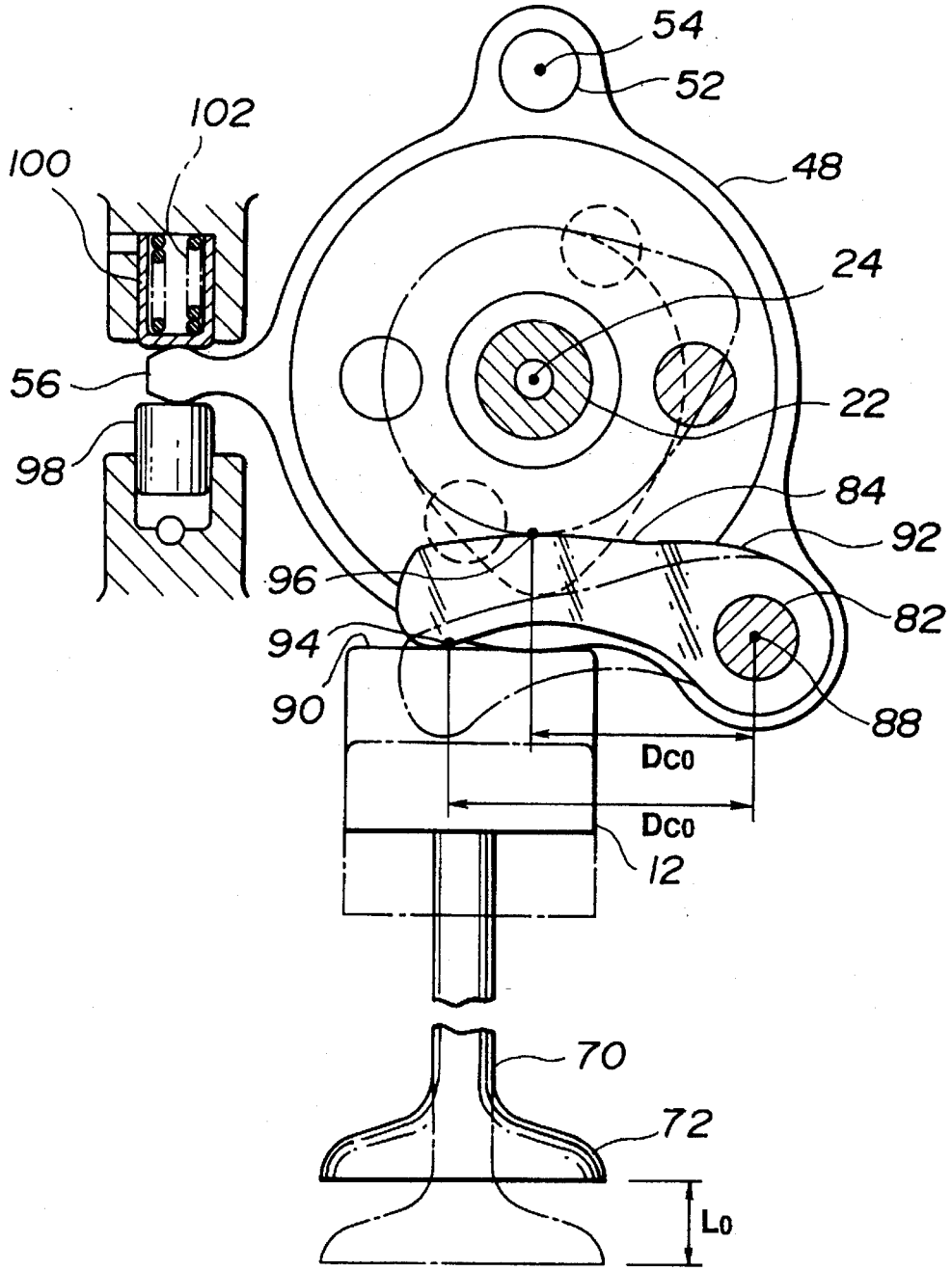
FIG. 7 is a view similar to FIG. 5 with an intermediate member held in concentric relation with a driving shaft by a support.

During operation at high engine speeds, the solenoid of the solenoid valve 106 is energized in response to the output, namely, an ON signal, of the control unit 108. Energization of the solenoid causes the solenoid valve 106 to take the first valve. position 110, allowing the supply of hydraulic fluid to the piston chamber 104, moving the hydraulic piston 98 towards the projected position. As a result, the disc housing 48 assumes- the position shown by FIGS. 5 and 7 in which the annular disc 40 is concentric with the driving shaft 22. In other words, the axis 50 of the annular disc 40 agrees completely with the shaft axis 24 and has lost its identity. Rotation of the cam lobe 62 actuates the rocker arm 84 which in turn actuates the cylinder valve via the tappet 12. The valve lift diagram, which is determined by the profile of the cam lobe 62, is illustrated by the fully drawn curve in FIG. 9C. In FIG. 9C, the valve lift is indicated at $L_0$. Referring to FIG. 7, the fully drawn cylinder valve shows the valve closed position, while one-dot chain drawn cylinder valve shows the valve fully open position. The valve lift is illustrated by the character $L_0$. The valve lift $L_0$ is the product of the maximum cam lift and a so-called rocker arm ratio that is expressed by $D_{V0}/D_{C0}$.

A shift from operation at high engine speeds to operation at low engine speeds is effected by denergizing the solenoid operated valve 106. This causes this valve 106 to take the second valve position 114, allowing the discharge of hydraulic fluid from the piston chamber 104. As a result, the disc housing 48 is pivoted counterclockwise from the position shown in FIG. 7 to the position shown in FIG. 8. During this motion, the rocker shaft 82 is moved in such a direction as to move the contact point of the cam follower portion 96 with the cam lobe 62 toward the opposite end portion of the rocker arm 84, decreasing the rocker arm ratio.

Figure 8:
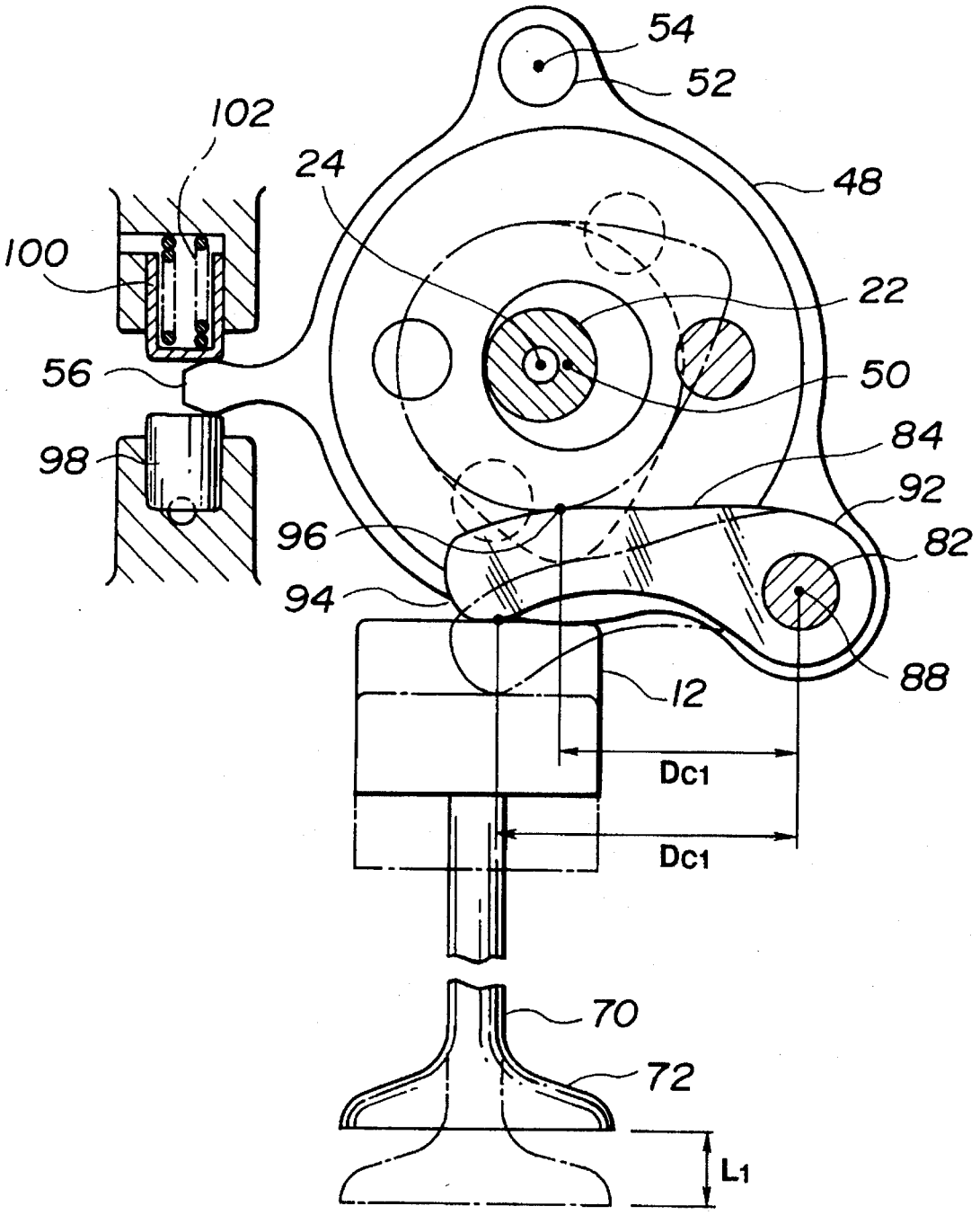
FIG. 8 is a view similar to FIG. 7 with the support pivoted to hold the intermediate member in eccentric relation with the driving shaft.

At the position shown in FIG. 8, the disc housing 48 produces eccentricity between the axis 50 of the disc 40 and the shaft axis 24. Under this condition, the cam 16 with the two cam lobes 62 and 64 is driven faster than the rotational speed of the driving shaft 22 over one part of the driving shaft revolution and then driven slower than the rotational speed of the driving shaft 22 over another part of the same revolution as shown by the dotted line curve in FIG. 9A. The dotted line curve in FIG. 9B shows that the phase of the cam 16 advances over one part 25 of the driving shaft revolution and then retards over another part of the same revolution. The dotted line curve in FIG. 9C shows a valve lift diagram of the cylinder valve. The valve lift is indicated at $L_1$. Comparing FIG. 8 with FIG. 7, it will be noted that the distance $D_{C1}$ is longer than its counterpart $D_{C0}$ since the contact point of the cam follower portion 96 with the cam lobe 62 has moved toward the opposite end portion 94 of the rocker arm 84, while the distance $D_{V1}$ remains substantially equal to its counterpart $D_{V0}$. As a result the rocker arm ratio $D_{V1}/D_{C1}$ (see FIG. 8) becomes smaller than the ratio $D_{VO}/DC_{CO}$ (see FIG. 7). This explains why the valve lift $L_1$ is smaller than the valve lift $L_0$.

From the preceding description, it should be noted that the rocker arm pivots through a reduced angle at the position shown in FIG. 8 so that acceleration and deceleration to which the cylinder valve is subjected has been suppressed (see FIGS. 9A and 9C). This makes much contribution to a reduction in driving loss and noise in the valve drive train. Great torsional vibrations between the driving shaft and cams can be eliminated or at least reduced.

It should also be noted that even if the engine valve control mechanism stays in the position shown in FIG. 8 at high engine speeds owing to a hydraulic delay, the stress which the cylinder valve is subjected to is suppressed to a sufficiently low level owing to the reduced valve lift.

According to the preceding embodiment, the rocker shaft 82 is directly supported by the disc housing 48. Alternatively, the rocker shaft may be supported by another member which is in conjoint operation with the disc housing.

According to the preceding embodiment, the rocker arm ratio is reduced by moving the contact point of the cam follower portion 96 with the cam lobe 62 toward the opposite end portion 94 of the rocker arm. The reduction of the rocker arm ratio can be conducted by replacing a fulcrum by a new fulcrum. This modification is illustrated in FIG. 10.

Figure 10:
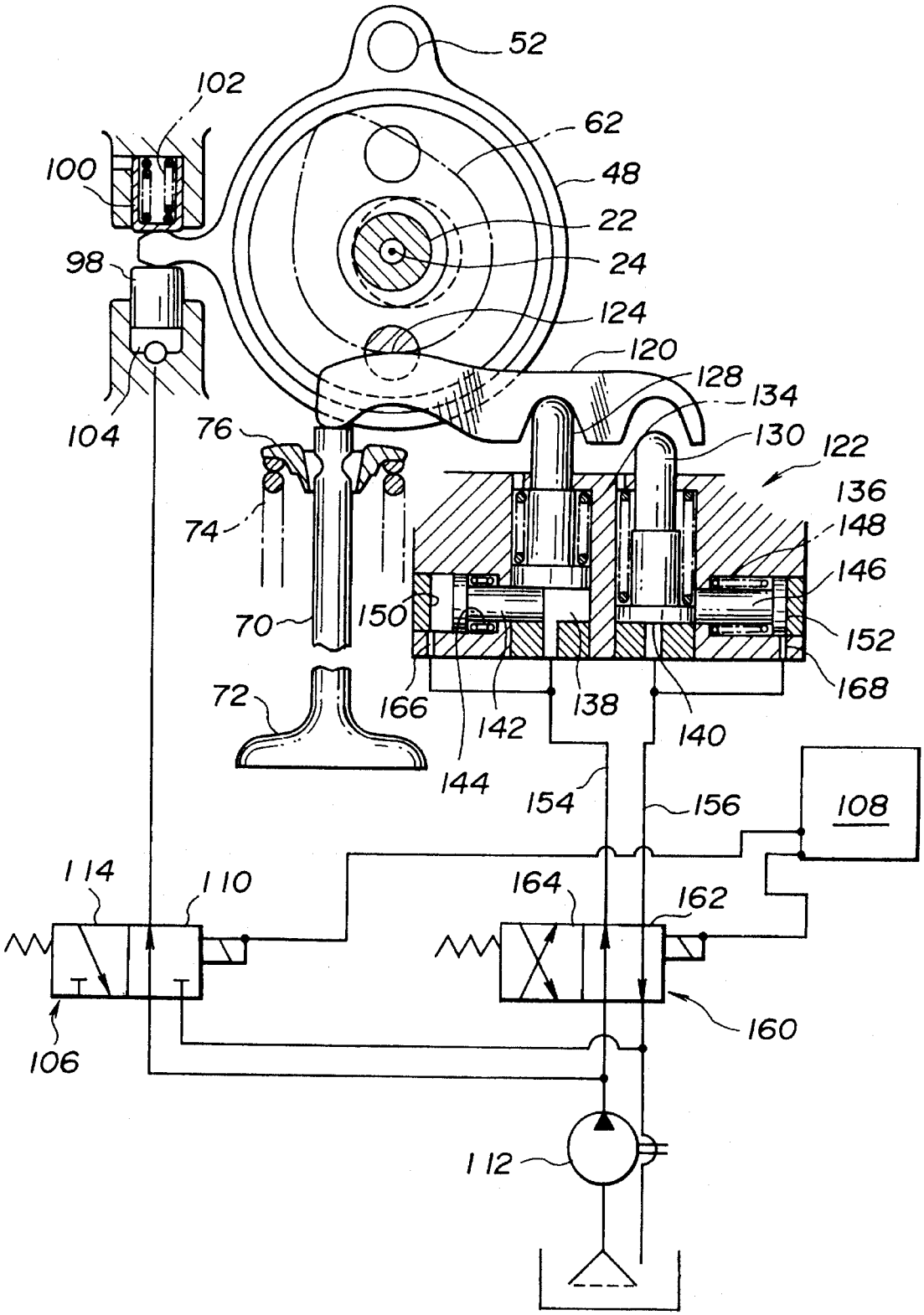
FIG. 10 is a diagram showing a second embodiment of an engine valve control mechanism.

The embodiment shown in FIG. 10 is substantially the same as the preceding embodiment (see FIGS. 5 and 6) except the fact that the rocker arm 84 and the rocker shaft 82 have been replaced with a new rocker arm 120 and a fulcrum adjuster 122. Thus, the same reference numerals as used in the preceding embodiment are used to designate like or similar parts. According to this embodiment, the contact point of a cam follower portion 124 of the rocker arm 120 with a cam lobe 62 remains. substantially unaltered over the whole range of engine operation. The rocker arm 120 has pivotally supported at its ends by a stem portion 70 of a cylinder valve and the fulcrum adjuster 122. The rocker arm 120 includes a first recessed portion 126 adapted to pivotally receive a hemispherical end of a first piston 128 of the fulcrum adjuster 122 and a second recessed portion 130 adapted to pivotally receive a hemispherical end of a second piston 132 of the fulcrum adjuster 122. During operation at high engine speeds, the first piston 128 projects to pivotally support the rocker arm 120, while the second piston 132 is retracted. During operation at low engine speeds, the first piston 128 is retracted and the second piston 132 projects to pivotally support the rocker arm 120. The second portion 132 is distant further from the contact point of the cam follower portion 124 with the cam lobe 62 than the first portion 128 is. Thus, the reduced valve lift is produced during operation at low engine speeds.

The first and second pistons 128 and 132 are biased toward their retracted positions by means of springs 134 and 136 and moved to their projected positions in response to supply of hydraulic fluid to the corresponding piston chambers 138 and 140. In order to hold the first piston 128 at its projected position, there is provided a hydraulic latch 142 biased to a retracted position by a spring 144. In order to hold the second piston 132 at its projected position, there is a hydraulic latch 146 biased to a retracted position by a spring 148. The hydraulic latch 142 is in the form of a stepped diameter piston including an enlarged diameter end exposed to a latch chamber 150, and the hydraulic latch 146 is in the form of a stepped diameter piston including an enlarged diameter end exposed to a latch chamber 152. Supply of hydraulic fluid to and discharge thereof from the piston chamber 138 and the latch chamber 150 are effected by a hydraulic line 154, while supply of hydraulic fluid to and discharge thereof from the piston chamber 140 and the latch chamber 152 are effected by a hydraulic line 156. There is provided a solenoid operated control valve 160 having a first valve position 162 and a second valve position 164. In the first valve position 162, there is supply of hydraulic fluid to the piston chamber 138 and latch chamber 150 via the hydraulic line 154, while the hydraulic line 156 is drained. In the second valve position 164, the hydraulic line 154 is drained and hydraulic fluid is supplied to the piston chamber 140 and the latch chamber 152. Under the control of a control unit 108, the solenoid of the solenoid operated control valve 160 is energized during operation at high engine speeds and the first valve position 152 is established, while it is denergized during operation at low engine speeds so that the second valve position 164 is established From the preceding description of this embodiment, it is evident that the valve lift is reduced during operation at low engine speeds since the second piston 132 projects to pivotally support the rocker arm 120. It is be noted that in order to delay pressure build-up in the latch chamber 150 or 152 as compared to that in the piston chamber 138 or 140, restricted orifices 166 and 168 are arranged. Specifically, supply of hydraulic fluid to the fluid line 154 causes lift of the first piston 128 to its projected position and then movement of the latch 142 to a position to lock the first piston 128, while supply of hydraulic fluid to the hydraulic fluid line 156 causes lift of the second piston 132 to its projected position and then movement of the latch 146 to a position to lock the second piston 132.

In order for increased understanding of operation of the driving shaft and cam assembly, reference should be made to GB-A 2 263 529 published on Jul. 28, 1994 and U.S. patent application Ser. No. 08/077,510 filed on Jun. 17, 1993 and assigned to the same assignee to which the present application is to be assigned, both of which published document and application have been incorporated herein by reference.

What is claimed is:

1. An engine valve control mechanism, comprising:

a cylinder valve;

a driving shaft rotatable about a shaft axis;

a cam rotatable relative to said driving shaft to actuate said cylinder valve;

a support;

an intermediate member supported in said support for rotation about an axis;

a first coupling between said driving shaft and said intermediate member at a first position spaced from said shaft axis;

a second coupling between said intermediate member and said cam at a second position angularly spaced from said first position with respect to said shaft axis, said first and second couplings being so spaced from said shaft axis that they are at varying distances from said axis of said intermediate member during operation, each of said first and second couplings having a movable connection to permit the variation in its distance from said axis of said intermediate member;

means for varying an eccentricity of said intermediate member which is the relative position of said axis of said intermediate member to said shaft axis; and means responsive to the varying eccentricity of said intermediate member for varying a valve lift of said cylinder valve.

2. An engine valve control mechanism as claimed in claim 1, wherein said valve lift varying means includes a rocker arm operatively associated between said cam and said cylinder valve to press said cylinder valve, and said support having a fulcrum pivotally supporting said rocker arm.

3. An engine valve control mechanism as claimed in claim 2, wherein said eccentricity varying means includes said support pivotable about an axis parallel to said shaft axis between a first position in which said intermediate member is concentric with said shaft axis and a second position in which said intermediate member is eccentric with said shaft axis.

4. An engine valve control mechanism as claimed in claim 3, wherein said eccentricity varying means and said valve lift varying means include hydraulic means for moving said support.

5. An engine valve control mechanism as claimed in claim 1, wherein said valve lift varying means include a rocker arm operatively associated between said cam and said cylinder valve to press said cylinder valve, and a fulcrum adjuster having a first pivot and a second pivot, said first and second pivots being selectively put into an operative position to pivotally support said rocker arm.

6. An engine valve control mechanism as claimed in claim 5, wherein said eccentricity varying means includes said support pivotable about an axis parallel to said shaft axis between a first position in which said intermediate member is concentric with said shaft axis and a second position in which said intermediate member is eccentric with said shaft axis.

7. An engine valve control mechanism as claimed in claim 6, wherein said eccentricity varying means and said valve lift varying means include hydraulic means for moving said support and rendering one of said first and second pivots of said fulcrum adjuster to pivotally support said rocker arm.

* * * * *